United States Patent [19]

Neher et al.

[11] 4,395,870

[45] Aug. 2, 1983

[54] METHOD AND DEVICE FOR PIECING A YARN IN A SPINNING ROTOR OF AN OPEN END SPINNING DEVICE

[75] Inventors: Heinz Neher; Peter Artzt, both of Reutlingen; Heinz Muller, Metzingen; Gerhard Egbers, Reutlingen, all of Fed. Rep. of Germany

[73] Assignee: Schubert & Salzer, Ingolstadt, Fed. Rep. of Germany

[21] Appl. No.: 276,005

[22] Filed: Jun. 22, 1981

[30] Foreign Application Priority Data

Jun. 26, 1980 [DE] Fed. Rep. of Germany ..... 3023959

[51] Int. Cl.[3] ..... D01H 15/00

[52] U.S. Cl. ..... 57/263

[58] Field of Search ..... 57/263, 261, 408, 412

[56] References Cited

U.S. PATENT DOCUMENTS

| | | | |
|---|---|---|---|
| 3,782,089 | 1/1974 | Landwehrkamp et al. | 57/263 |
| 3,791,128 | 2/1974 | Landwehrkamp et al. | 57/263 |
| 4,055,942 | 11/1977 | Stahlecker | 57/263 |
| 4,083,169 | 4/1978 | Lawe et al. | 57/263 |
| 4,102,116 | 7/1978 | Derichs et al. | 57/263 |

*Primary Examiner*—Donald Watkins

*Attorney, Agent, or Firm*—Julian W. Dority

[57] ABSTRACT

A method and apparatus for piecing a yarn in a spinning rotor of an open end spinning device is disclosed wherein an increased quantity of fibers is momentarily fed into the spinning rotor after the yarn is returned to the spinning rotor, whereupon the fiber supply is reduced to the normal supply quantity. Preferably, during termination of the spinning process, fibers are stored between a supply device and a fiber opening device which on commencing the piecing process are suddenly released, while at the same time the fiber supply resumes at the normal rate. For effecting the method an abutment surface (110) is preferably provided in a feed channel (11) on the side of a clamping point (15) of a clamping lever (5) for acting on the feed channel (11) facing away from the opening roller (2). The abutment surface (110) is abutted by a tow guide funnel (51) of the clamping lever (5) during a first part of the pivotal movement of the clamping lever, while during a second part of the pivotal movement of the lever, a clamping end (51) of the clamping lever (5) engages the fiber tow 4 at the clamping point (15) of the feed channel (11) and the guide funnel lifts from the abutment surface (110) while the feed channel is displaced away from the effective area of a fiber opening roller 2. A fiber store 6 is built up between a feed roller 10 and the fiber opening roller 2 during pivotal movement of clamping lever which is actuated by electromagnet 55 in response to a yarn break sensed by monitor 31. Upon release of the clamping lever 5 after stopping and restart of the spinning process, the feed channel is released bringing the fiber store suddenly into the operating area of opening roller 2 for release of the stored fibers in the spinning rotor 3 while at the same time normal fiber supply resumes.

10 Claims, 8 Drawing Figures

FIG. 7
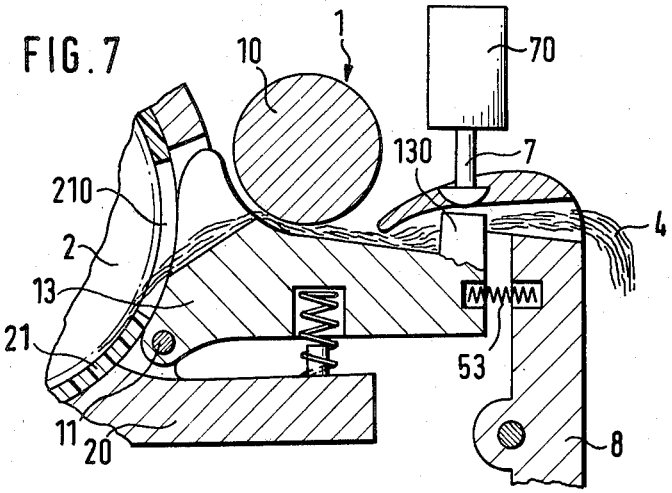
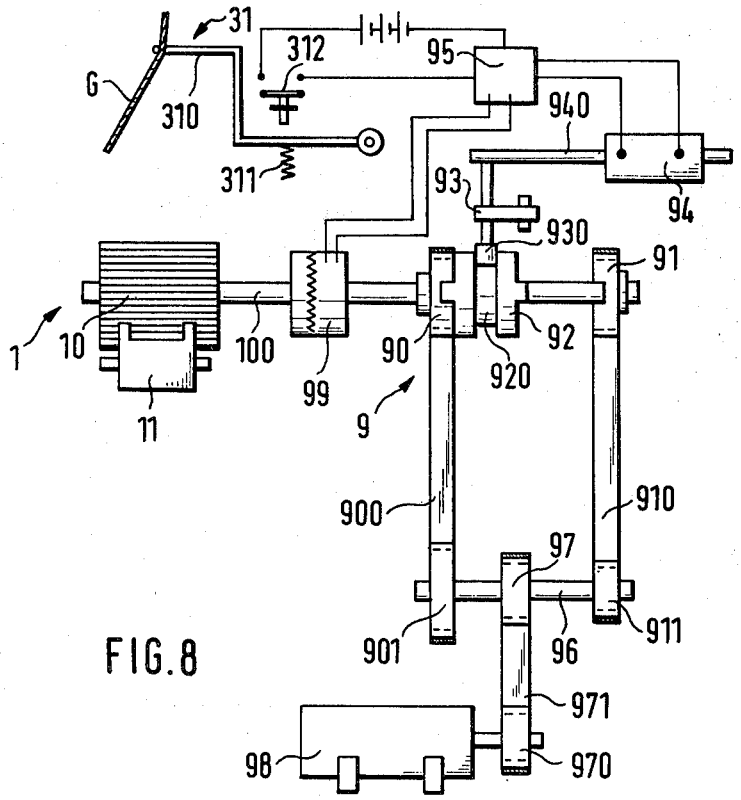
FIG. 8

METHOD AND DEVICE FOR PIECING A YARN IN A SPINNING ROTOR OF AN OPEN END SPINNING DEVICE

BACKGROUND OF THE INVENTION

The present invention relates to a method for piecing a yarn in a spinning rotor of an open end spinning device, where after the yarn is re-introduced into the spinning rotor, the supply of fibers to the spinning rotor commences, a well as a device for effecting the method.

Attempts have repeatedly been made to improve the yarn piecers in open end spinning by varying the sequence of yarn return and the start of fiber supply. Thus, for example, it is known initially to feed fibers to the spinning rotor and then to feed the yarn back into the spinning rotor (DE-OS 2 505 943). In this way the yarn end fed back into the spinning rotor is deposited upon a fiber ring already present and into which the torsion imparted to the yarn end can be transferred so that the fiber ring can be exploded and the yarn end can be tied in. Since the torsional movement of the transferable yarn end is limited, it is possible to work only with limited fiber supply. However, this results in a weak or thin point in the yarn in the area of the yarn piecer.

In order to eliminate the difficulties encountered during exploding of the fiber ring, it is already known to cut off the fiber tuft arranged in the area of the fiber opening roll prior to piecing, and to lead off the fibers thus severed and to build up the fiber ring formed in the spinning rotor from the shortened fibers prior to returning the yarn end into the spinning rotor. (DE-OS 2 507 153). Such a fiber ring can be very easily exploded since the fiber ring has only very limited strength. However, since here too the fiber ring is exploded, it cannot contribute towards strengthening the yarn piecing achieved in this manner.

It is also known to commence the fiber supply only after the yarn is returned (DE-OS 1 560 298).

However, since the yarn is allowed to remain in the fiber collecting channel for only a very short period of time, and since otherwise there is a danger of the fibers becoming severed by twisting, only relatively few fibers can be fed into the spinning rotor, so that by this manner too a weak point will appear in the piecing area.

It is therefore the object of the present invention to provide a method and an apparatus for producing relatively short piecing regions in the yarn with sufficient strength and the smallest number of variations from the normal yarn strength.

SUMMARY OF THE INVENTION

According to the invention this problem is solved in that after feeding of the yarn to the spinning rotor, an increased quantity of fibers is momentarily fed into the spinning rotor and then the fiber supply is reduced to the normal supply quantity. In this way, it is made possible that the yarn end does not have to explode any fiber ring already present in the spinning rotor, but that the fiber ring is formed above the yarn end. Since this yarn end continuously transfers to the fiber ring being formed the torque imparted to itself during the feeding in of the fibers, the fiber ring is always open at the tying in point so that the problem of having to explode the fiber ring does not even exist. Since an increased fiber quantity is momentarily fed into the spinning rotor, a fiber quantity is kept aside at the time of piecing which insures that the piecing region produced in the yarn has a relatively high strength.

The temporary increase in fiber supply is chosen in such a way that the deviations produced by the unavoidable jump in the yarn diameter formed by the end of the yarn being returned are kept as small as possible with respect to the deviations in normal yarn diameter.

Preferably, the increased fiber quantity is produced by storing fibers between a supply device and a fiber opening device during discontinuing of the spinning process, which fibers are suddenly released during the piecing process while at the same time the fiber supply commences at the normal supply rate.

It has proved to be particularly advantageous when the yarn fed back into the spinning rotor is deposited on 20% to 40% of the internal circumference of the spinning rotor and the released stored fiber mass corresponds to 30% to 50% of the fiber mass which is present in a fiber ring during the normal spinning process. In this way the thickness point is kept within acceptable limits in the pieced area of the yarn without an excessively weak point simultaneously appearing behind it.

For effecting the method it is possible to use a supply device which can have its supply speed raised for short periods of time. For this purpose according to the invention the supply device is provided with a drive by means of which it can be driven for short periods during starting at increased supply speeds and then at normal supply speeds.

According to a preferred embodiment of the method and apparatus according to the invention a fiber store is disposed between the supply device and the fiber opening device which picks up and stores fibers momentarily during discontinuing of the spinning process which fibers are suddenly released during piecing together. The fiber store makes available the increased quantity of fiber necessary for piecing together. The arrangement of the fiber store after the supply device on the one hand insures that the stored quantity of fibers really does get fed into the spinning rotor in sudden bursts, while its arrangement before the fiber opening permits the fibers to be fed individually into the spinning rotor in the normal manner and not as an uncontrolled batch.

According to an advantageous embodiment of the object of invention the fiber store is arranged in the area of a fiber tuft forming the continuation of the housing wall surrounding the fiber opening roller and is opened by a movable fiber tuft support. The fiber tuft support which holds the fiber tuft in the normal spinning process in the operating area of the fiber opening roller opens the fiber store and makes it possible for the fiber tuft to move out of the operating area of the opening roller and into the store until the stored fiber quantity is again released by moving back the fiber tuft support. The fiber tuft thus again reaches the operating area of the opening roller.

According to a simple to construct and easy to control embodiment of the invention the fiber tuft support forms part of the feed channel extending in the circumferential direction of the opening roller. The end of the feed channel, arranged in the direction of conveyance, is provided with a swivel axis for the feed channel. When the feed channel is arranged so that it rests on a glide mounting of the opening roller housing, the swivel axis is preferably in the shape of a glide stop for the feed channel. During the usual deviations in the fiber tow in front of the spinning device the feed channel slides on the glide mounting in the usual manner without reaching the stop. When the feeding stops, the feed channel is pressed in a direction towards the glide stop until the feed channel comes to rest against the glide stop. Any further pressure on the feed channel causes it to make a swivel movement thereby producing a gusset which forms the fiber store between the opening roller and feed channel.

In principle it is possible to provide separate control members for clamping the fiber tow and for displacing the feed channel for the purpose of forming a fiber store. However, according to a preferred embodiment, the feed channel at the side of the clamping point facing away from the opening roller is provided with an abutment surface which cooperates with a clamping member during a first part of the swivel movement of the feed channel while during a second part of the swivel movement it rests against the clamping point of the feed channel and is raised off the abutment surface.

In order to enable the precise control of the yarn piecing process, the release of the fiber supply is effected in response to the restored yarn tension of the yarn fed back into the spinning rotor, the fiber store being connected for control purposes with a yarn monitor which monitors the yarn and tension thereof.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 7 is an alternate embodiment of the apparatus according to the invention, and FIG. 8 is a schematic view illustrating apparatus according to the invention which utilizes a variable drive instead of the fiber store to supply an increased fiber quantity momentarily upon piecing up of a yarn end.

DESCRIPTION OF A PREFERRED EMBODIMENT

Figure 1:
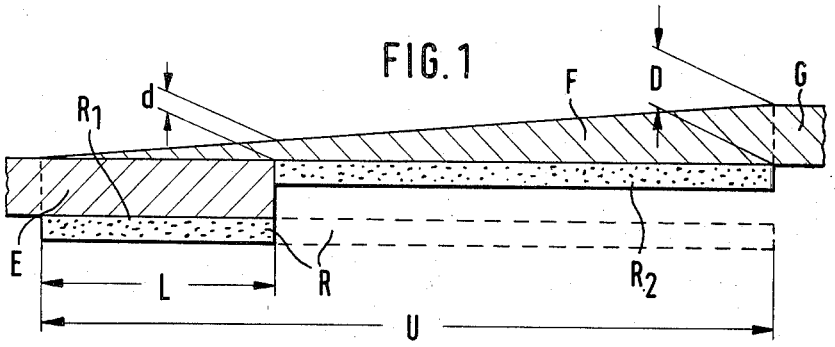
FIG. 1 is a schematic view illustrating the piecing region of a yarn when fibers are supplied to the spinning rotor prior to returning the yarn end.

First of all, the invention will be explained by comparison of FIGS. 1 through 3. U represents the circumference of the collecting channel 3*a* of a spinning rotor 3 (FIG. 4) in which a fiber ring R is formed by pre-feeding before piecing together a yarn end E which is fed back into the spinning rotor 3 and becomes deposited upon the already existing fiber ring R. Rotation of the spinning rotor 3 causes yarn end E to be given a twist (FIG. 1). When the centrifugal force is low, the yarn end E merely rolls off the fiber ring R without tying in, so that the success rate in piecing together is slim even when the drawing off of the yarn is slightly delayed. Success can only be achieved by a very slight pre-feeding of fibers and by pre-feeding short fibers so that the fiber ring R can be easily opened up. If as a result of a high number of rotations of the spinning rotor 3 the centrifugal force is also very high, yarn removal has to commence earlier in order to prevent yarn end E from becoming severed through twisting. Although the increased pressing force makes it easier to split open the fiber ring R, only a relatively short time is available for this.

During the piecing process fibers F are fed to the spinning rotor 3 in the usual manner and become deposited on the yarn end E as well as on the fibers of the fiber ring R. Depending on which part of the circumference U of the collecting channel of the spinning rotor the yarn end E has been deposited during the return feed, the fibers F, which reach the spinning rotor after yarn return, have attained a strength d. For example, if the fed back yarn length corresponds to 30% of the rotor circumference, 30% fibers of fiber strength D are fed onto the yarn end until the continuous re-withdrawal of this yarn length. Since during the piecing process the fiber ring R has to be opened up, only the strength d at the end of the returned yarn end E serves to connect the yarn end E with the newly formed yarn G. However, despite the appearance of an optical yarn strength, a weak point comprising only 30% fibers appears in the yarn G. In order to illustrate this process of exploding the fiber ring R, the part R1 of the fiber ring R which is in contact with the fed back yarn end E and the part R2 of the fiber ring R which is in contact with the newly formed yarn G in FIG. 1 are shown displaced with respect to eath other.

Figure 2:
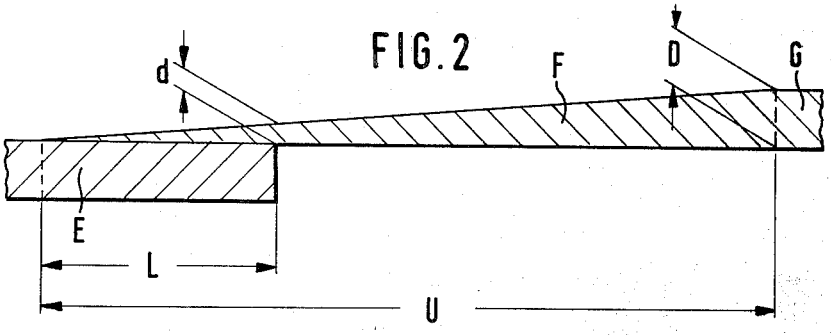
FIG. 2 is a schematic view of the piecing region of a yarn when fibers are being supplied to the spinning rotor simultaneously with the returning of the yarn end.
Figure 3:
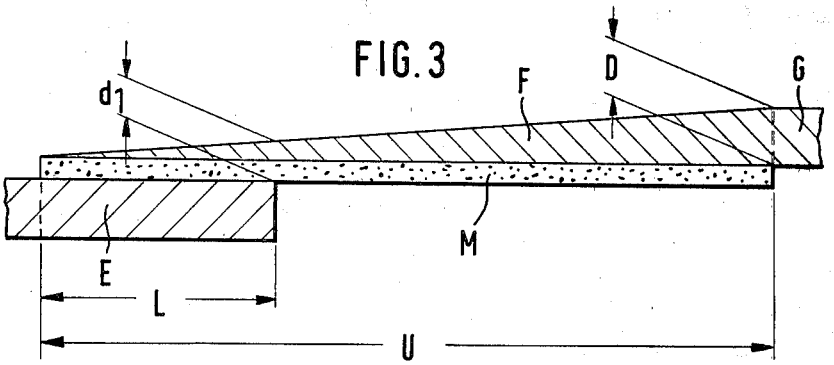
FIG. 3 is a schematic view of the piecing region of a yarn when a larger quantity of fibers is suddenly supplied to the spinning rotor simultaneously with the returning of the yarn end and the fiber supply is then returned to normal.

FIG. 2 shows a piecing section as it develops when no fibers are supplied to the spinning rotor 3 prior to the return of the yarn end E to the spinning rotor. The piecing region is then optically weaker, however, with respect to the strength d of the newly formed yarn which is used for the connection, there is no difference from the piecing section shown in FIG. 1.

Since the fibers F of the fiber ring R formed prior to the return of the yarn end E into the spinning rotor do not contribute anything to the strength of the piecing region in the yarn and since the fiber ring R has to be exploded in any case, an increase in the strength can only be achieved by depositing the yarn end E on the circumference U of the spinning rotor around as wide as an arc as possible. However, because of the danger of twisting off the yarn end E, it may remain in the spinning rotor 3 only a short time making this possible only to a limited degree. In practice, the returned yarn end E as a rule takes up approximately 30% of the circumference U of the spinning rotor.

The solution according to the invention is now explained with reference to FIG. 3. In order to achieve a good strength in the piecing region, the fiber quantity M which is fed onto the returned yarn end E is increased. At the same time normal fiber supply commences. The fiber quantity M which is additionally fed onto the yarn end E is supplied in a sudden burst and only for a very short period. It is intended that, after returning the yarn end E, the circumference U of the spinning rotor fills up with a quantity of fibers which on the one hand provides an adequate yarn strength $d_1$ at the end of the yarn end E and which on the other hand also prevents the appearance of an excessively great jump in strength at the piecing section where it joins the normal yarn G. Since the fiber quantity M is released suddenly, it is already available in the region of the end of the returned yarn end E for strengthening the piecing section. The fiber ring formed by this quantity of fiber M also does not have to be exploded when tying in the yarn end E, so that it contributes wholly in connecting the old yarn end E with the new yarn G.

The quantity of fibers M which is suddenly released is determined by the desired yarn strength $d_1$, which depends somewhat on the fiber material being spun, and the length L of the section of the yarn end E being deposited in the spinning rotor 3. It has shown to be advantageous if the suddenly released fiber quantity M corresponds to 30% to 50% of the fiber quantity which is present in a fiber ring R during the normal spinning process. When at the same time the yarn end E becomes deposited over 20% to 40% of the circumference U of the spinning rotor, the strength $d_1$ amounts to approximately 70% of the normal yarn strength D (based on the mean values of the above number) so that a considerable increase in strength in the piecing region can be achieved with respect to the yarn pieces hitherto used. The success rate in piecing together yarns therefore rises substantially so that yarn piecing can now also be carried out under conditions of e.g. higher speeds of the spinning device, which hitherto made yarn piecing impossible.

Under certain conditions it may be preferable to deviate from the values whether upwards or downwards.

Figure 4:
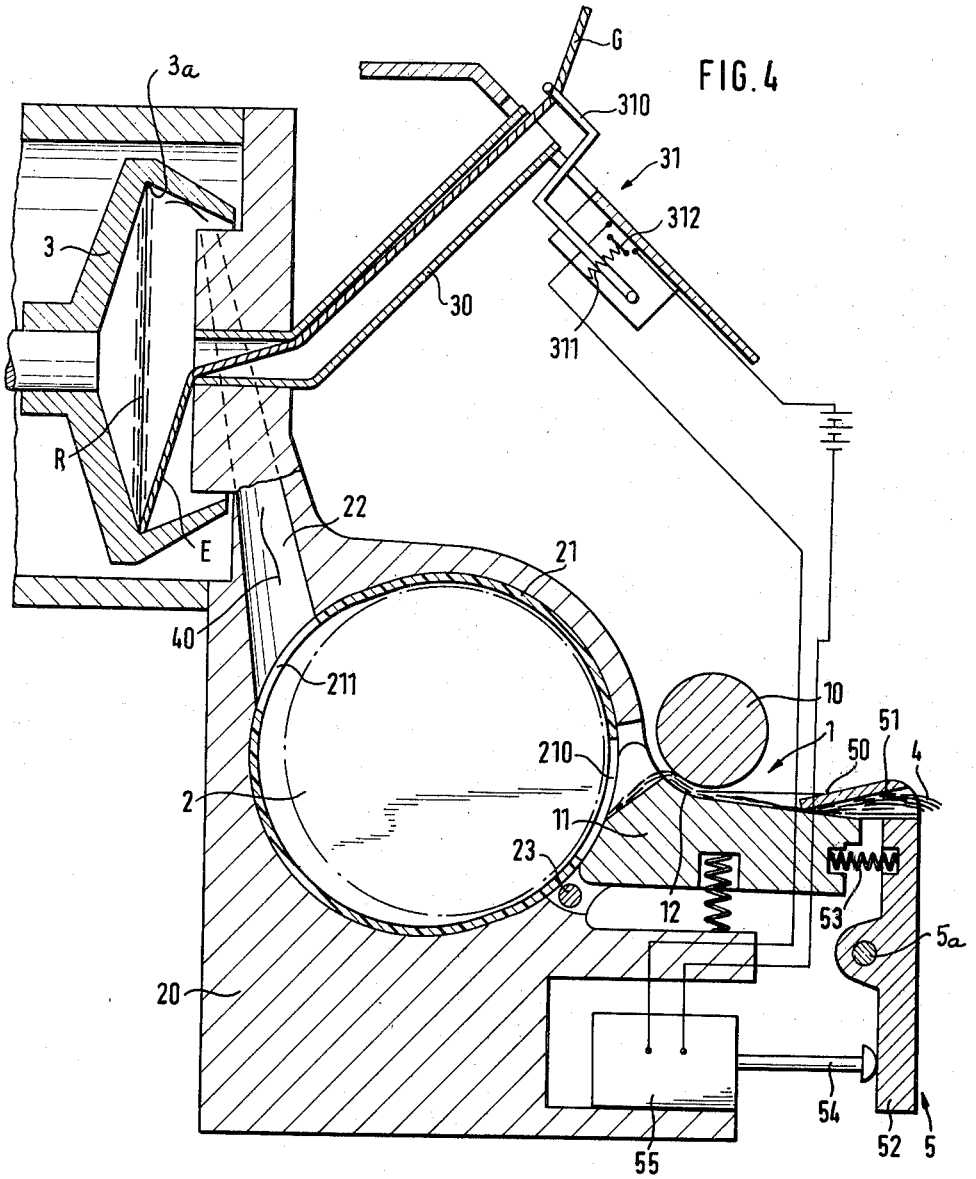
FIG. 4 is a schematic cross-sectional view illustrating apparatus constructed according to the invention during a normal spinning process.

The increased fiber quantity M may be made available in the spinning rotor 3 at the time of piecing in a number of ways. A first embodiment is described with the aid of FIGS. 4 to 6. As shown in FIG. 4, roving or fiber tow 4 opened into of individual fibers 40 is introduced into the interior of the spinning rotor 3 in the usual manner by means of a feeder 1 and a fiber opening roller 2, where the individual fibers 40 reach the collecting channel 3*a* and form into a fiber ring R. The fiber ring R is tied in with a yarn end E of a yarn G in a known manner which through a yarn withdrawal tube 30 is drawn off by means of a pair of yarn withdrawal rollers (not shown) and wound up on a bobbin (not shown) in the normal way. On its way to the bobbin the yarn G is monitored by a yarn monitor 31. The negative pressure in the spinning rotor 3 necessary for spinning is produced in a known manner and therefore is not shown.

In the embodiment shown, the feed device 1 comprises a driven feed roller 10 as well as a feed channel 11 which is in resilient contact with the same by means of spring 11*a* (FIG. 5) which provides a glide mounting in the housing 20.

The opening roller 2 is arranged in a housing 20 which also carries the feed channel 11, while the feed roller 10 is mounted independent of the housing 20. The feed channel 11 is provided with a clamping lever 5 which has its clamping part 50 arranged in the direction of the fiber tow conveyance before the nipping area 12 of the feed device 1. Clamping part 50 is adapted to cooperate with the feed channel 11 in order to form a clamping point 15 for the fiber tow 4.

Figure 5:
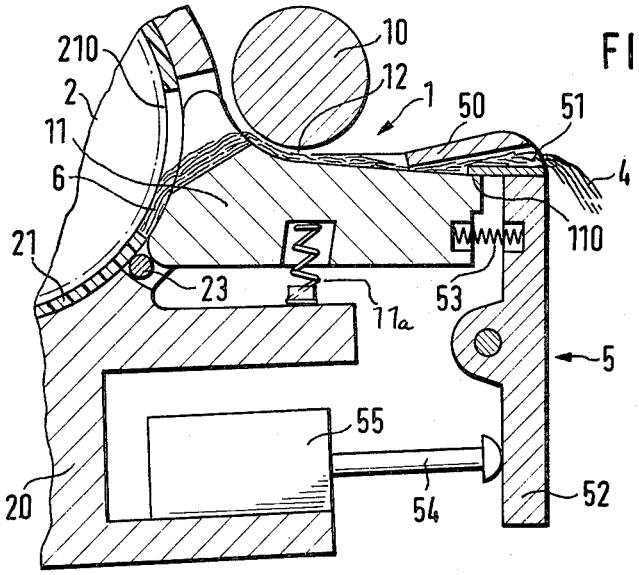
FIG. 5 is a schematic sectional view illustrating the apparatus of FIG. 4 in a storage position.
Figure 6:
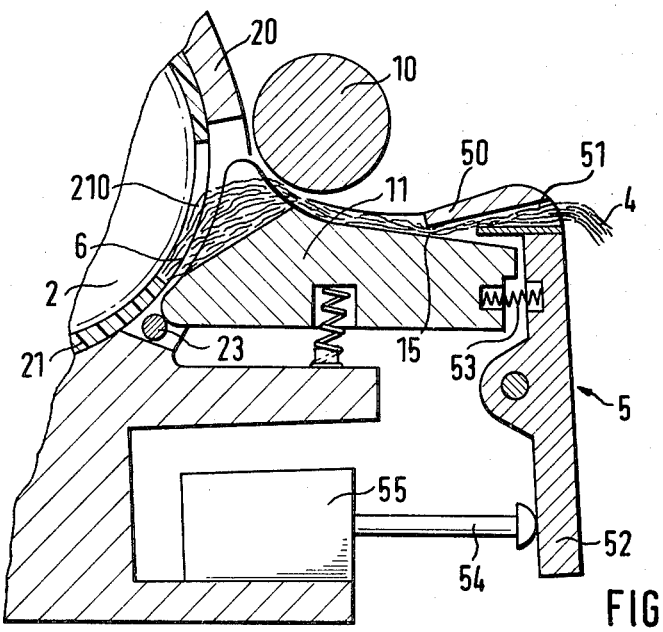
FIG. 6 is a schematic sectional view of the apparatus of FIG. 4 in the storage position with fiber tow stopped by clamping down.

The clamping lever 5 has a fiber tow guide funnel 51 for feeding the fiber tow 4 between the feed channel 11 and the clamping end 50 of the clamping lever 5 towards the feed roller 10. The drive end 52 of the double-arm clamping lever 5 abuts against push rod 54 of electromagnet 55 under the effect of a pressure spring 53. The fiber tow guide funnel 51 extends beyond the clamping lever 5 in the direction of fiber tow conveyance but terminates in front of the clamping end 50 of the clamping lever 5. The clamping lever 5 is furthermore arranged with respect to the feed channel 11 and moves in such a way that during the first part of its pivot movement about pivot 5*a* (FIG. 5), the fiber tow guide funnel 51 rests against an abutment surface 110 of the feed channel 11 without the clamping part 50 exerting any clamping action on the fiber tow 4. During a second part the further pivotal movement of the clamping lever 5 the clamping end 50 rests on the feed channel 11, the fiber tow guide funnel 51 then again being lifted off the feed channel 11 (FIG. 6).

The housing 20 is coated with a thin metallic lining 21 which may be in the form of a sleeve insert which has a supply opening 210 in the area of the feed device 1 and has a discharge opening 211 in the area of a fiber feed channel 22 leading into the spinning rotor 3. The outside of this lining 21 is contacted by feed channel 11 in such a way as to always remain in contact with this lining 21 when set in motion by the movements caused by the fiber tow 4 being supplied. Further possibilities of radially supporting a feed channel are described in DE-OS 2 448 584.

Outside the normal sphere of glide movement by the feed channel 11 there is provided a glide stop 23 in the direct vicinity of the lining 21 on the side of the feed channel 11 facing away from the feed roller 10 which prevents a glide movement of the feed channel 11 beyond the normal frame. When a pressure is exerted on the feed channel before the nipping zone 12 in the direction of fiber tow travel, this pressure swivels the feed channel 11 after the feed channel 11 reaches and contacts glide stop 23.

The device described in FIG. 4 works as follows.

During the normal spinning process the clamping end 50 of the clamping lever 5 is raised from the feed channel 11 so that the rotating feed roller 10 draws the fiber tow 4 through the fiber tow guide funnel 51. The feed roller pulls the tow beneath the clamping end 50 of the clamping lever 5 and brings it into the effective area of the opening roller 2 which in the normal manner opens and disentangles the fiber tow 4 to form individual fibers 40 which then reach the spinning rotor 3 for spinning.

If a yarn breakage occurs, the sensor 310 of the yarn monitor 31 is released and displaced by a pretensioned pressure spring 311 to make a contact with 312 which energizes the electromagnet 55 actuating push rod 54 which engages and pivots the clamping lever 5 counterclockwise. The clamping lever 5 contacts the abutment surface 110 and thereby moves the feed channel 11 until it abuts the glide stop 23. The feed channel 11 is displaced from the effective area of opening roller 2 with the aid of fiber tow guide funnel 51 without the clamping end 50 of the clamping lever 5 clamping the fiber tow 4 (FIG. 5). This causes a store means 6 of fibers in the shape of a gusset to be formed between the side of the feed channel 11 facing the opening roller 2 and the opening roller 2. The fiber tuft of the further supplied fiber tow 4 enters this gusset even though to a lesser extent individual fibers 40 are still being opened out of the fiber tow 4 and reach the spinning rotor 3.

The clamping lever continues its pivot movement. The movement of the feed channel 11 as well as those of the clamping lever 5 cause the clamping end 50 of the clamping lever 5 to be moved into clamping contact with the fiber tow 4 and the feed channel 11 at the clamping point 15 while the feed channel 11 and the fiber tow guide funnel 51 become separated from one another (FIG. 6). The supply of fiber tow to the opening roller 2 is terminated by clamping the fiber tow 4, and by displacing the feed channel away from the effective area of the opening roller the fiber store 6 is further increased.

The piecing process is effected by introducing a yarn end E into the yarn withdrawal pipe 30 which is sucked into the spinning rotor 3 as a result of the negative pressure existing in the spinning rotor 3 and which because of the centrifugal forces produced by the rotating spinning rotor 3 is deposited in the collecting channel of the spinning rotor 3.

At the same time the yarn monitor 31, about whose sensor 310 the returned yarn end E is placed, signals the renewed presence of the normal spinning tension, which stops current flowing to the electromagnet 55. The push rod 54 now releases the clamping lever 5 whose clamping end 50 through the action of pressure spring 53 completely releases the fiber tow 4 and immediately afterwards the fiber tow guide funnel 51 completely releases the feed channel 11. By pivoting back the clamping lever 5 the feed channel 11 is returned to its working position in which it re-establishes the clamping of the fiber tow 4 between itself and the feed roller 10. The fiber quantity M (FIG. 3) stored in the fiber store 6 is suddenly brought within the effective area of opening roller 2 and released while at the same time normal fiber supply again commences. Also, the withdrawal of thread G is put into operation in a manner now shown.

By means of the aforementioned device fibers are stored between the feed device 1 and the opening roller 2 when the spinning process is terminated which fibers F on commencing the piecing process are suddenly released with the simultaneous commencement of normal fiber supply.

The object of the invention is not limited to the embodiment shown in FIGS. 4 to 6 but can also be used in a variety of other applications. For example, the yarn store 6 may be a suction pipe directed between the feed device 1 and the opening roller 2, which may be provided with a screen a short distance from its end faced towards the fiber tow 4 and which can be activated or inactivated in response to yarn monitor 31. For example, in the event of yarn breakage fibers are sucked up which on commencing the piecing process are again released (e.g. by reversing the air flow), whereby through a timing device it can be insured that the suction or blowing air is effective, only for as long as is absolutely necessary.

In the embodiment described above the yarn store 6 is arranged in the area of the fiber tuft as a continuation of the wall of the housing 20 surrounding the opening roller 2 and can be opened by a movable yarn tuft support. The fiber store 6 is closed by a fiber tuft support when feed channel and thus the stored fibers are moved away from the operating area of opening roller 2 and is opened when the feed channel is moved back into the operating area of the roller. The yarn tuft support in the embodiment example shown is formed by a swivelling feed channel 11. However, it is also possible to provide a fiber support which can move in the circumferential direction of the housing wall and which can enable the fiber tuft to move out of the area coming within the sphere of influence of the opening roller 2 and which on the other hand can again bring the fiber tuft quickly within the effective region of the roller 2 in order therefore to achieve a sudden opening and feeding of the stored fiber quantity.

It is also not absolutely necessary to provide a glide stop 23 in order to effect the pivotal or swivel motion of the feed channel 11. FIG. 7 shows an embodiment example in which there is provided a feed channel 13 which is pivotably arranged on a pivot axis 14 which is arranged at a point where according to FIGS. 4 to 6 the glide stop 23 is arranged.

When the feed channel 13 makes a pivotal movement beyond the normal limit away from feed roller 10, even in an embodiment such as this, a yarn store 6 is formed between the surface of the feed channel 13 facing the opening roller 2 and the roller itself.

Preferably, a single control member serves to control the fiber store 6 as well as the clamping of the fiber tow 4. However, it is also possible to provide for this separate control members. According to FIG. 7, for example, a clamping member 7 is provided which cooperates with a stop 130 provided on the feed channel 13. In the embodiment shown the clamping member 7 is the push rod of an electromagnet 70 which is controlled in response to a yarn monitor 31 (FIG. 4). The clamping lever 8 provided for the fiber tow 4 is thus independent of the clamping member 7 and by connecting a suitable timing member (not shown) can be provided with a pre-arranged delay.

It is also within the scope of the invention to provide a controllable yarn store 6 such as by a pivoting feed channel 11 or 13 and a feed roller 10 which can be stopped with the aid of a clutch. Then it is possible to control and to adjust independently from one another the fiber storage and the stopping and starting of the fiber supply.

Also it is not necessary to provide the fiber opening device as an opening roller 2 and it is not necessary to the supply device to comprise a feed roller 10 and a feed channel 11 or 13. Moreover, the supply device may also comprise of two rollers. It is also possible to have the supply device 1 arranged as a pair of input rollers and fiber opening device as a pair of discharge rollers of a stretching device. The fiber store will then of course have to be constructed and adapted accordingly, e.g. in the form of an intermediate pneumatic fiber store. This fiber store can also work pneumatically-mechanically in combination by, for example, a diaphragm covering or exposing a pneumatic and reversible fiber store.

In the embodiment examples shown the fiber store 6 and the supply device are respectively controlled in response to the yarn monitor 31 (via the clamping lever 5 or 8). However, it is also conceivable that these elements are controlled manually or from another control point, e.g. the main control board of the machine, possibly only in addition to.

FIG. 8 shows a further embodiment of the invention in which the feed roller 10 has a clutch 9. The clutch 9 on the drive shaft 100 of the feed roller 10 has two freely rotatable drive wheels 90 and 91 which can be alternately engaged with a wheel 92 which is connected with the drive shaft 100. For this reason wheel 92 has a circumferential groove 920 in which a control lever 93 engages with its control member 930. The control lever 93 is connected with the armature 940 of an electromagnet 94 which is electrically connected with the yarn monitor 31 via a control member 95.

The drive wheels 90 and 91 are connected via chains 900 or 910 with drive wheels 901 and 911 which are mounted on a common shaft 96 which, in turn, is driven by a motor 98 via drive wheels 97 and 970 which are connected with each other via a chain 971. Wheel 911 is of a smaller diameter than wheel 901.

Between the feed roller 10 and the clutch 9 there is provided another clutch 99 which is also controlled by the control member 95.

For stopping the fiber supply, as a result of the sensor 310 of the yarn monitor 31 dropping, the clutch 99 is disengaged by control member 95 thereby stopping the drive roller 10. During the piecing operation when the yarn tension has been restored again in the fed back yarn G the control member 95 again engages the clutch, but at the same time the wheel 92 is engaged with the drive wheel 91 so that the feed roller 10 is driven at increased speed by motor 98 via drive connection 970, 971, 97, 96, 911, 910, 91, 100 whereby an increased quantity of individual fibers F reach the spinning rotor 3. Immediately after, the fiber supply quantity is again normalized by reversing the wheel 92 through the control member 95 (timing member) and thus the drive connection 98, 970, 971, 97, 96, 901, 900, 90, 100, 10, is now completed. By means of the drive described above the supply device 1 can thus be driven for short periods at increased feed speeds and then at normal feed speeds so that with a device of this kind also it is possible to feed the increased fiber quantity M (FIG. 3) onto the returned yarn end E in such a way as to be available in the region of the yarn piecing section.

The aforementioned description shows that the object of invention can be changed in many ways and this also includes such embodiments in which the parts described can also be substituted by equivalents or combinations.

What is claimed is:

1. A method for piecing a yarn in a spinning rotor of an open end spinning device comprising the steps of:

introducing the yarn into the spinning rotor for piecing-up of said yarn;

momentarily feeding an increased supply quantity of fibers to said spinning rotor after introducing said yarn for piecing-up;

reducing the supply quantity of fibers fed to said spinning rotor to a normal supply quantity after momentarily feeding said increased supply quantity of fibers to said spinning rotor; and thereafter feeding said normal supply quantity of fibers to said spinning rotor for the spinning of said yarn after piece-up.

2. Method according to claim 1, comprising storing a supply of fibers subsequent to a stopping of the spinning device and suddenly releasing said stored fibers during said piecing process while said normal supply of fibers is begun at the same time.

3. Method according to claim 2, wherein said yarn introduced into the spinning rotor takes up to 20% to 40% of the space of the internal circumference of the spinning rotor and said released stored fiber mass corresponds to 30% to 50% of the fiber mass which is present in a fiber ring during the normal spinning process.

4. Apparatus for piecing a yarn after a yarn break in an open end spinning device having a spinning rotor, a supply device for supplying fiber to said spinning rotor at a normal rate during spinning of yarn, and a fiber opening device, said apparatus comprising:

drive means for driving said supply device, said drive means driving said supply device momentarily during piecing-up of said yarn at a supply rate which is increased above that of said normal rate of fiber supply.

5. Apparatus for piecing a yarn after a yarn break in a oen end spinning device having a spinning rotor, a supply device for supplying yarn fiber to said rotor at a normal fiber supply rate during a yarn spinning process, and a fiber opening device, said apparatus comprising:

fiber store means disposed between said supply device and said fiber opening device;

said fiber store means receiving fibers momentarily upon termination of said yarn spinning process; and said fiber store means releasing said received fibers to supply fibers to said spinning rotor at a rate increased above said normal rate during piecing of said yarn.

6. Apparatus according to claim 5, wherein said opening device includes a fiber opening roller, a housing surrounding said roller, said fiber store being arranged in the area of a fiber tuft which forms a continuation of said housing surrounding the opening roller, and a movable fiber tuft support which opens and closes said fiber store.

7. Apparatus according to claim 6, wherein said supply device includes a feed roller and a feed channel, said fiber tuft support comprising a part of said feed channel extending in a circumferential direction of said fiber opening roller, an end of said feed channel being arranged in a direction of conveyance about which said feed channel swivels.

8. Apparatus according to claim 7, wherein the housing of the opening roller includes a glide mounting for said feed channel arranged adjacent said opening roller, and a glide stop for said feed channel which provides a swivel axis about which said feed channel swivels.

9. Apparatus according to claim 7 including a clamping member having a clamping point at which said clamping member can be brought into operation to act upon the feed channel, said feed channel having an abutment surface provided on a side of the clamping point facing away from the opening roller, said abutment surface cooperating with said clamping member during a first part of a pivot movement of said clamping member while during a second part of the pivot movement it rests against said clamping point of said feed channel and lifts from said abutment surface.

10. Apparatus according to claim 5 wherein said fiber store is connected for control purposes with a yarn monitor which monitors the yarn.

* * * * *